United States Patent [19]

Boyadjieff et al.

[11] 4,421,175

[45] Dec. 20, 1983

[54] METHOD OF DRILLING AND CASING A WELL

[75] Inventors: George I. Boyadjieff, Anaheim; Andrew B. Campbell, San Marino, both of Calif.

[73] Assignee: Varco International, Inc., Orange, Calif.

[21] Appl. No.: 297,120

[22] Filed: Aug. 28, 1981

[51] Int. Cl.[3] ..... E21B 19/10

[52] U.S. Cl. ..... 166/383; 175/171; 166/77; 166/102; 173/149; 254/29 R

[58] Field of Search ..... 166/77, 77.5, 78, 85, 166/98, 315, 378, 379, 380, 381, 383; 175/162, 171, 325; 254/29, 30, 31; 173/144, 145, 149, 150

[56] References Cited

U.S. PATENT DOCUMENTS

| | | | |
|---|---|---|---|
| 1,879,929 | 9/1932 | Fortune | 173/149 |
| 1,894,039 | 1/1933 | Hill | 175/325 |
| 2,126,933 | 8/1938 | Stone et al. | 166/77 |
| 2,641,444 | 6/1953 | Moon | 166/381 |
| 3,154,146 | 10/1964 | Brown | 166/77.5 |
| 3,888,318 | 6/1975 | Brown | 166/77 |
| 4,085,796 | 4/1978 | Council | 166/77.5 |
| 4,209,066 | 6/1980 | Watson | 166/380 |

*Primary Examiner*—Ernest R. Purser
*Assistant Examiner*—William P. Neuder
*Attorney, Agent, or Firm*—William P. Green

[57] ABSTRACT

A well drilling rig having a rotary table for driving a drill string rotatively and having jacking mechanism for lowering casing into the well after drilling, with the jacking mechanism including fluid pressure actuated piston and cylinder means which may be left in the rig during drilling and which are positioned low enough in the rig to avoid interference with operation of the rotary table. The jacking mechanism also includes a structure which is adapted to be connected to the piston and cylinder means when the casing or other well pipe is to be lowered and which is actuable upwardly and downwardly and carries one of two pipe gripping units for progressively jacking the pipe downwardly by vertical reciprocation of that structure. The reciprocating structure may take the form of a beam extending between two pistons and actuable thereby, with a second beam being connected to cylinders within which the pistons are contained and being utilized to support the second gripping element. In one form of the invention, the rotary table when in use is supported by this second beam.

15 Claims, 9 Drawing Figures

METHOD OF DRILLING AND CASING A WELL

BACKGROUND OF THE INVENTION

This invention relates to well drilling rigs having improved jacking mechanisms for moving a well pipe vertically. The invention will be described primarily as utilized for lowering a string of casing into a well after completion of the drilling operation.

The casing string which is lowered into a well after drilling is often extremely heavy and difficult to support and control, and in many instances has a weight greater than the maximum load which the rig drawworks, traveling block, etc. are capable of suspending. In copending United States Patent Applications Ser. No. 169,718 entitled "Well Casing Jack Mechanism", filed July 17, 1980 by George I. Boyadjieff and Andrew B. Campbell, Inventors and United States Patent Application Ser. No. 268,763 entitled "Well Pipe Jack", filed June 11, 1981 by George I. Boyadjieff and Andrew B. Campbell, Inventors, there have been disclosed jacking mechanisms which can be positioned in the rig and utilized after completion of the drilling operation to lower a string of casing into the well. These jacking devices preferably include two piston and cylinder mechanisms located at different sides of the well axis and which actuate one of two pipe gripping units upwardly and downwardly relative to the second of those units to jack the casing downwardly in a step by step manner.

SUMMARY OF THE INVENTION

The present invention provides improved jacking mechanisms of this general type which are especially designed to facilitate and simplify the conversion of the rig from drilling condition to a casing lowering condition. A rig constructed in accordance with the invention may be changed from drilling condition to jacking condition very rapidly in a manner attaining a substantial saving in the amount of rig time which is required for the combined process of first drilling and then casing a well. A further purpose of the invention is to provide a new load supporting arrangement in which the weight of the rotary table of a rig is supported by the same structural elements which support the casing load during lowering of the casing into the well.

An arrangement embodying the invention includes fluid pressure actuated piston and cylinder means, preferably including two power cylinders at different sides of the well axis and containing two pistons which are actuable upwardly and downwardly relative to the cylinders. These piston and cylinder means are positioned in the rig at a location enabling them to be left in the rig during drilling, and without interference with operation of the rotary table. When a jacking operation is to be performed, a structure is connectable to the piston and cylinder means, preferably by attachment to the upper ends of its pistons, and forms an extension projecting upwardly and acting to carry the gripping unit which releasably grips and supports the casing string. A second gripping unit may be supported by another structure which is preferably connected to the upper ends of the two cylinders. In a preferred arrangement, the rotary table itself when in use is supported by this second structure, and may be easily removable from that structure after drilling in order to enable placement of one of the gripping units on that structure. The first mentioned structure which is connected to the pistons of the actuating units may include two rod extensions which are attached to the piston rods and project upwardly therefrom to carry the upper of the two gripping units.

BRIEF DESCRIPTION OF THE DRAWINGS

The above and other features and objects of the invention will be better understood from the following detailed description of the typical embodiments illustrated in the accompanying drawings in which.

DESCRIPTION OF THE PREFERRED EMBODIMENTS

Figure 1:
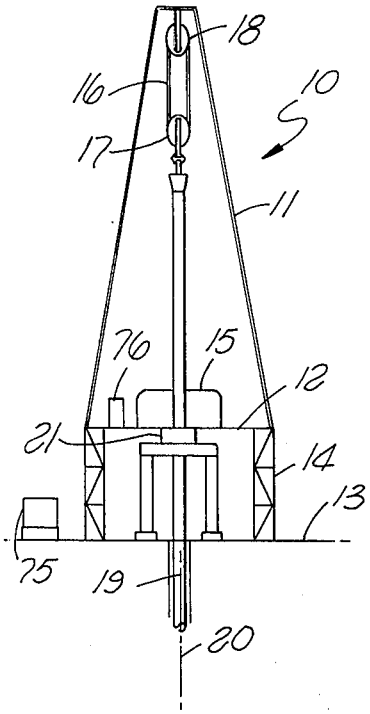
FIG. 1 is a representation of a well drilling rig having jacking mechanism constructed in accordance with the invention, with the rig being shown during a drilling operation.
Figure 3:
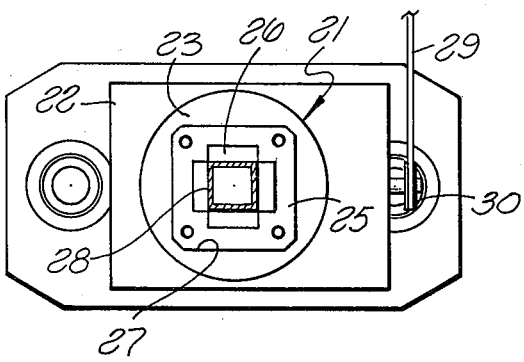
FIG. 3 is a plan view taken on line 3—3 of FIG. 2.

The well drilling rig 10 illustrated diagrammatically in FIG. 1 includes the usual upwardly projecting derrick or mast 11 which has a floor 12 supported at a level spaced above the earth 13 by a substructure 14. The drawworks 15 acts through a line 16 to raise and lower a traveling block 17 relative to a crown block 18 in order to suspend the drill string 19 which is turned about a vertical axis 20 by a conventional rotary table 21 to drill the well.

Figure 2:
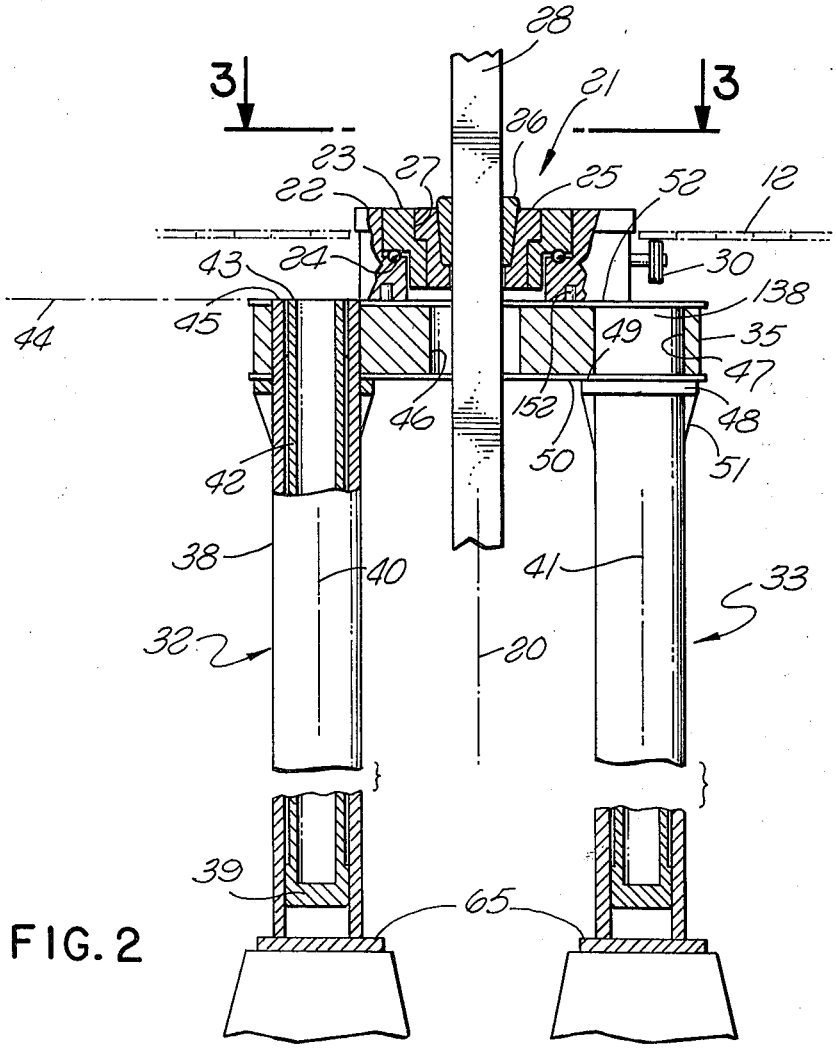
FIG. 2 is an enlarged fragmentary view representing a portion of FIG. 1.

As seen in FIG. 2, the rotary table 21 includes a typically rectangular case or body 22 within which an inner essentially annular section 23 of the rotary table is mounted for rotation relative to body 22 about axis 20 and by appropriate bearings typically represented at 24. A master bushing 25 and kelly bushing 26 within the central opening 27 of the rotatable section of rotary table 21 act to drive a noncircular kelly 28 forming the upper section of the drill string. Section 23 of the rotary table is driven about axis 20 by power taken from the drawworks 15 through a chain 29 and sprocket 30 attached to the drive shaft of the rotary table. When not in use, rotary table 21 may be completely removed from the rig.

Figure 4:
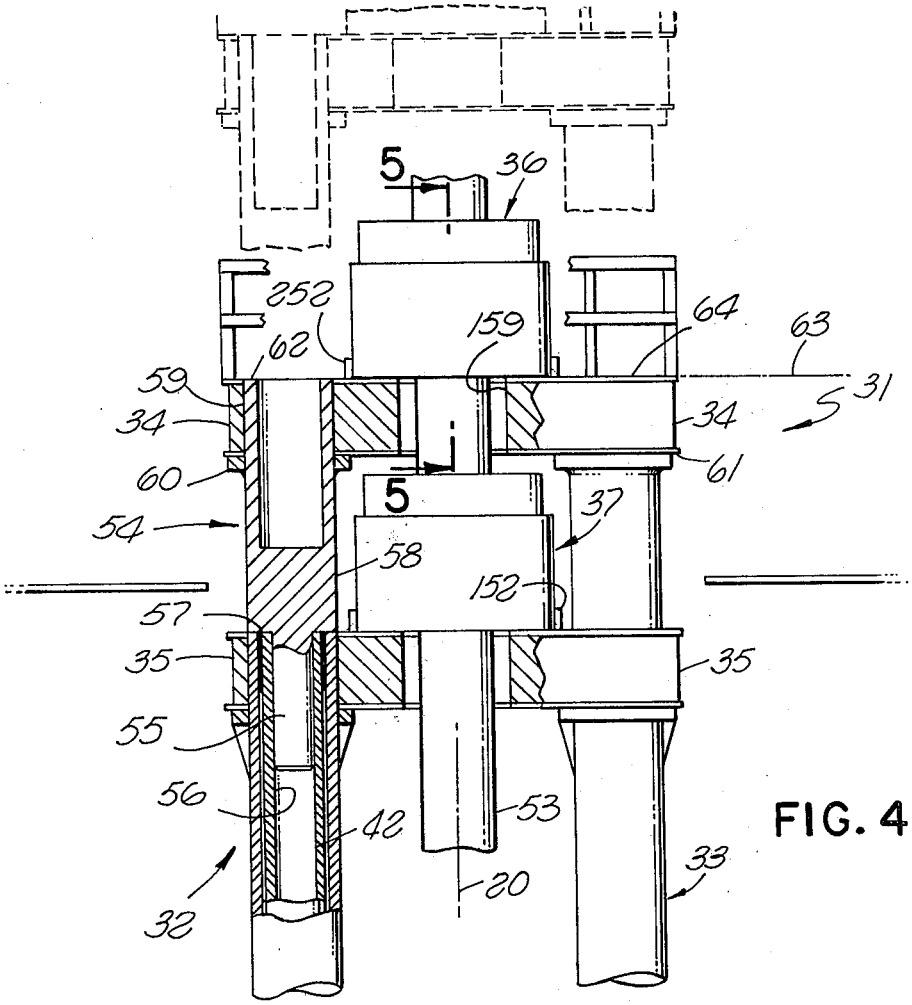
FIG. 4 is a view similar to FIG. 4, but showing the apparatus in jacking condition.
Figure 5:
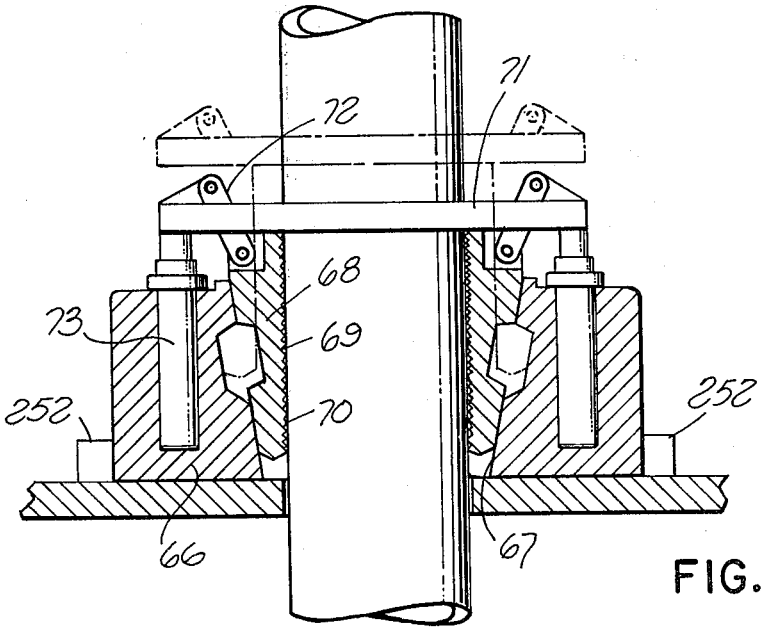
FIG. 5 is an enlarged fragmentary vertical section taken on line 5—5 of FIG. 4.

The jacking mechanism of the form of the invention shown in FIGS. 1 through 5 is represented generally by the number 31 in FIG. 4. This jacking mechanism includes two piston and cylinder units 32 and 33 supporting two upper and lower beams 34 and 35, which in turn support two casing gripping units 36 and 37, with the upper beam 34 and unit 36 being actuable upwardly and downwardly relative to the lower beam and lower unit 37 to attain a jacking action. The piston and cylinder mechanisms 32 and 33 and lower beam 35 also function to support rotary table 21 in the FIG. 2 drilling condition of the apparatus.

Each of the piston and cylinder mechanisms 32 and 33 includes an outer vertically extending cylinder body 38 and a piston 39 which is actuable upwardly and downwardly within the corresponding cylinder body along a vertical axis 40 or 41 by pressure fluid pump into either the lower or upper end of the cylinder. The two axes 40 and 41 of the cylinders are preferably parallel to the main vertical axis 20 of the drill rig and drill string, and desirably are at diametrically opposite sides of the well axis. In FIG. 2 the pistons are illustrated in their lowermost positions, in which their piston rods 42 have their upper surfaces 43 lying in the same horizontal plane 44 as the upper end surfaces 45 of cylinders 38. The cylinders are appropriately closed at their lower ends, as by horizontal bottom plates 65, which may rest on concrete footings or other base elements supporting the cylinders in their upstanding condition from the ground.

Beam 35 extends horizontally between and interconnects the upper ends of the two cylinder bodies 38. This beam is a rigid structure which may be formed of a number of metal parts appropriately welded or otherwise secured rigidly together, but for simplicity of illustration is typically represented as a horizontally extending essentially one-piece body. This beam contains a central opening 46 through which the drill string and a casing string can extend downwardly, and two cylindrical openings 47 at diametrically opposite locations and centered about axes 40 and 41 and within which the upper externally cylindrical ends 138 of cylinders 38 are close fits. Each cylinder 38 has a ring 48 welded or otherwise secured to its outer surface and forming an upwardly facing annular shoulder 49 on which the horizontal undersurface 50 of beam 35 rests to support the beam in the FIG. 2 position from the cylinders. The flanges or shoulders 48 may be reinforced by triangular braces 51 welded to the cylinders and to the flanges. The upper surface 52 of beam 35 is preferably horizontal and parallel to undersurface 50, and lies in the same horizontal plane as do the upper extremities 43 and 45 of the pistons and cylinders in the FIG. 2 condition of the apparatus. Rotary table 21 is supported on this top horizontal surface 52 of beam 35, and may be appropriately located relative thereto and retained against rotation by engagement with locating lugs 152 which are secured to the beam and project upwardly therefrom into interfitting recesses in the underside of the rotary table. As will be apparent from FIG. 2, the upper surface 52 of beam 35 is preferably spaced a short distance beneath the level of rig floor 12, so that the upper portion of the rotary table is then approximately aligned with or projects slightly above the upper surface of the floor.

When the apparatus is to be utilized for lowering a string of casing 53 (FIG. 4) into the well, rotary table 21 is removed from beam 35, and the upper beam 34 and related parts are connected to the piston and cylinder mechanisms as seen in FIG. 4. For attaching beam 34 to piston rods 42 there are provided two rod extensions 54 having lower connecting pin portions 55 which may be externally cylindrical and close fits within cylindrical bores 56 formed in rods 42 to locate the rod extensions 54 in upwardly projecting alignment with rods 42. At the upper ends of their connecting pin portions 55, rod extensions 54 have annular downwardly facing shoulders 57 engageable with the upper ends of rods 42 to support the extensions 54 in the FIG. 4 positions. Above the level of shoulders 57, extensions 54 have larger diameter external surfaces 58, whose upper extremities project into and are close fits within cylindrical bores 59 formed in top beam 34 at diametrically opposite locations with respect to axis 20. Rings 60 welded or otherwise secured to portions 58 of rod extensions 54 are engageable with the horizontal undersurface 61 of beam 34 to support it in the FIG. 4 position of connection to the upper ends of extensions 54 in which position the upper extremities 62 of rod extensions 54 terminate in a horizontal plane 63 which contains the upper horizontal surface 64 of beam 34. A central passage 159 in beam 34 is aligned vertically with opening 46 in lower beam 35 for extension of the casing 53 therethrough.

The two gripping units 36 and 37 may be identical and of a known type having wedge slips for releasably gripping and supporting the casing. The upper of these gripping units 36 is illustrated somewhat diagrammatically in FIG. 5, as including an outer annular rigid body 66 having inner downwardly tapering slip bowl surfaces 67 engageable with wedge slips 68 to cam them inwardly into gripping engagement with the casing upon downward movement of the slips relative to body 66. The inner surfaces 69 of the slips are formed to have gripping dies or teeth 70 shaped to bite into the casing surface and effectively support it. The slips are suspended by a ring 71, to which the slips are connected by links 72 allowing radially inward and outward movement as the slips are actuated upwardly and downwardly, with such upward and downward actuation being effected by a number of circularly spaced piston and cylinder mechanisms 73 having their cylinders connected to body 66 and their pistons connected to ring 71. When the slips are in their full line active positions of FIG. 5, the casing is supported by the gripping unit, but when the slips are actuated to their upper broken line retracted positions of FIG. 5 the casing is free for movement downwardly relative to the slips.

To now describe briefly the use of the apparatus of FIGS. 1 through 5 in first drilling and then lining a well, the apparatus is in the condition illustrated in FIGS. 1 and 2 during the drilling operation, with piston and cylinder mechanisms 32 and 33 acting to support beam 35 and the rotary table 21 and with the rotary table being driven by the engine of drawworks 15 to turn kelly 28 and the remainder of the drill string. Vertical load forces are transmitted downwardly from the rotary table through beam 35 and the piston and cylinder mechanisms 32 and 33 to the ground. As a result, the substructure of the drill rig need not be of a strength capable of taking these load forces, and consequently that substructure can be constructed with less metal and less expense than in a conventional arrangement in which the load forces are transmitted to the ground through the rig framework.

After the well has been drilled to a desired depth, the drill string is withdrawn upwardly from the well and the rotary table 21 is removed from beam 35, following which the two rod extensions 54 are inserted downwardly into the upper ends of the piston rods 42 (FIG. 4), and the upper beam 34 is slipped downwardly about the two rod extensions 34 and to the FIG. 4 condition in which it interconnects the upper ends of the piston rod assemblies and is supported and vertically actuable thereby. The two gripping units 36 and 37 are placed on the upper horizontal surfaces of beams 34 and 35, in alignment with the vertical axis 20 of the well, and may be located thereon in any appropriate manner as by reception between locating lugs 152 and 252 projecting upwardly from the upper surfaces of the beams. The casing may then be progressively lowered in a step-by-step fashion by alternately moving upper gripping unit 36 upwardly and downwardly and alternately actuating the two gripping units to grip the casing. For example, the slips of lowering gripping unit 37 may first be actuated to grip casing 53 while pistons 39 are actuated upwardly within cylinders 38 to raise upper beam 34 and upper gripping unit 36 (with its slips released) to an elevated position diagrammatically represented in broken lines in FIG. 4. The upper gripping unit may then be actuated to grip the casing while the lower gripping unit is released, following which the pistons 39 are allowed to lower beam 34 and gripping unit 36 to thereby advance casing 53 downwardly into the well. After gripping unit 36 reaches its lowermost position (full lines in FIG. 4) gripping unit 37 can be actuated to again grip and suspend the pipe while gripping unit 36 is released and moved upwardly again to its uppermost broken line position to repeat the lowering cycle. Pressure fluid is supplied to the upper and lower ends of the cylinders and to the control cylinders 73 of the gripping units 36 and 37 from a source 75 of pressurized fluid (FIG. 1) under the control of a manually actuated control console 76 which may be located on the rig floor.

Figure 6:
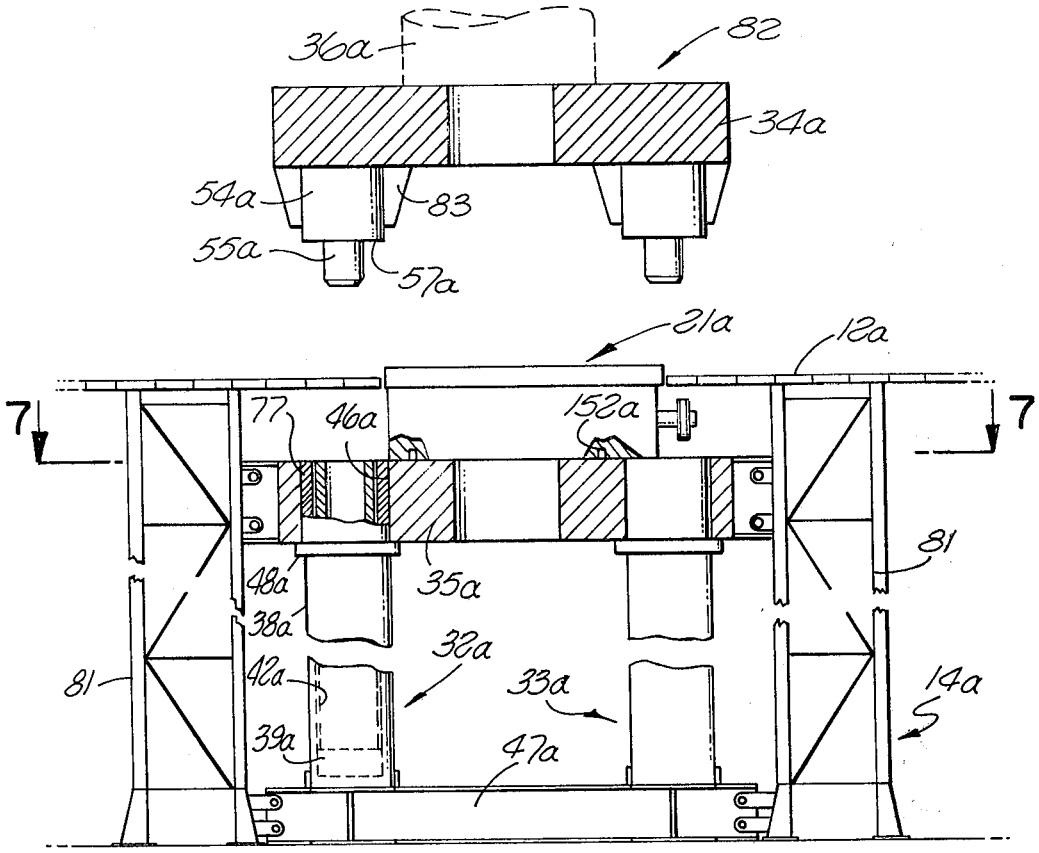
FIG. 6 is a vertical section through a second form of drilling rig embodying the invention.
Figure 7:
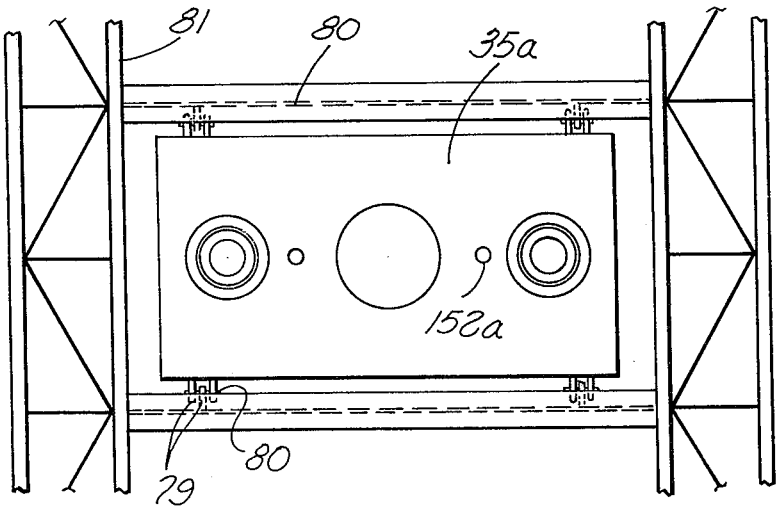
FIG. 7 is a fragmentary plan view taken on line 7—7 of FIG. 6.

FIGS. 6 and 7 illustrate a variational arrangement including two piston and cylinder mechanisms 32*a* and 33*a* supported from the ground on a portion 47*a* of a substructure 14*a* through which the floor 12*a* of a drill rig is mounted. A lower beam 35*a* is supported by the upper ends of the cylinders 38*a* of mechanisms 32*a* and 33*a*, with this support being effected by provision of flanges or shoulders 48*a* welded or otherwise rigidly secured to the cylinders near their upper ends. The portions 77 of the cylinders above flanges 48*a* project upwardly into openings 46*a* in beam 35*a*. As seen best in FIG. 7, beam 35*a* is retained against horizontal movement from the desired FIGS. 6 and 7 position by pins 78 extending through openings in aligned connector brackets 79 attached to the beam and to a pair of parallel frame elements or "I" beams 80 rigidly secured to the upstanding portions 81 of the rig framework or substructure 14*a*. As in the first form of the invention, the rotary table 21*a* rests on the upper horizontal surface of beam 35*a*, and is located relative thereto and retained against rotation by lugs represented at 152*a*, so that the rotary table can function to turn and support the drill string during a drilling operation.

When the apparatus of FIGS. 6 and 7 is to be employed for jacking a casing downwardly, the rotary table 21*a* is removed, and an upper beam assembly 82 is connected to the upper ends of piston rods 42*a* of pistons 39*a*. This upper extension structure 82 includes a top essentially horizontally extending beam 34*a* which may be similar to beam 34 of the first form of the invention but typically has at its underside two downwardly projecting rod extensions 54*a* which in this form of the invention may be rigidly welded or otherwise secured to beam 34*a*. Brackets 83 may be welded to the beam 34*a* and rod extensions 54*a* to assure rigidity of the overall structure. As in the first form of the invention, the rod extensions 54*a* have lower pin portions 55*a* which project downwardly into the upper ends of the tubular piston rods 42*a*, with the extensions 54*a* being supported by engagement of downwardly facing shoulders 57*a* on the extensions with the upper ends of the rods. When the upper structure 82 is appropriately connected to the upper ends of the piston rods, two gripping units 36*a* corresponding to units 36 and 37 of FIG. 4 may be placed on the two beams 34*a* and 35*a*, to alternately grip a string of casing and lower it progressively by vertical reciprocation of upper beam 34*a* relative to lower beam 35*a*.

Figure 8:
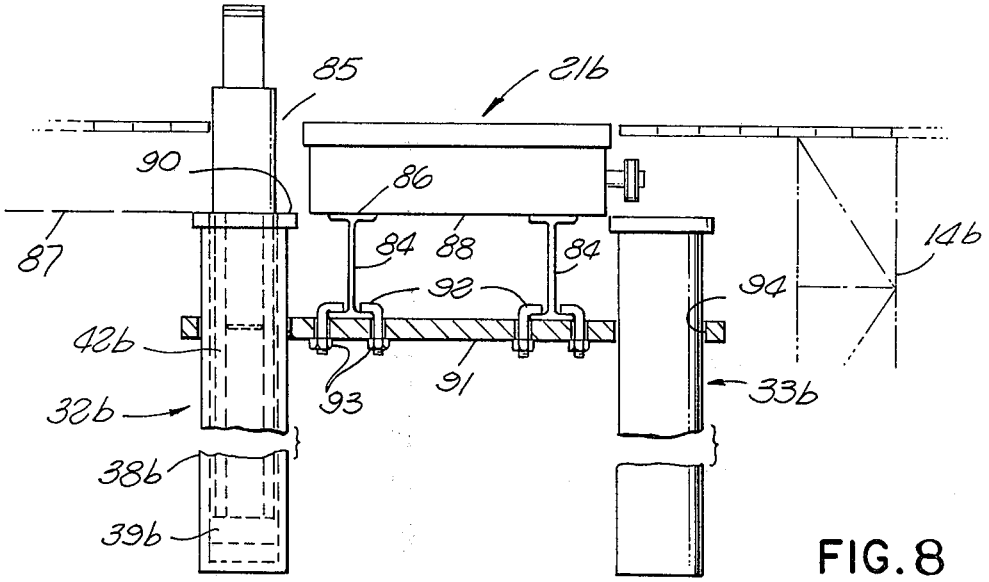
FIG. 8 is a view similar to FIG. 2 but showing another form of the invention with the rotary table in drilling position.
Figure 9:
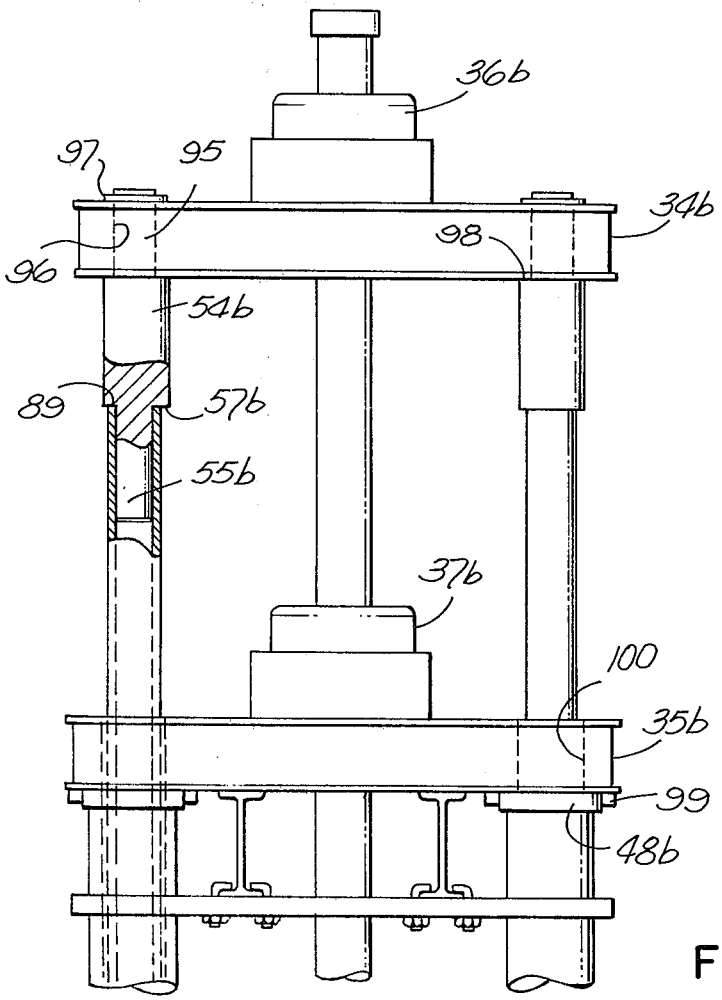
FIG. 9 shows the FIG. 8 arrangement with the jacking apparatus in place.

The third form of the invention shown in FIGS. 8 and 9 is an arrangement in which the rotary table 21*b* is not supported by the two piston and cylinder mechanisms 32*b* and 33*b* as in the first two forms of the invention, but rather is supported in more conventional manner on the usual rotary table supported "I" beams 84 which extend horizontally and parallel to one another across the rotary table receiving opening 85 in the rig floor 12*b*. The beams 84 are connected rigidly at their opposite ends to the substructure 14*b* of the drill rig, and have their upper surfaces 86 disposed in a horizontal plane 87 for engaging the undersurface 88 of the rotary table in supporting relation.

Each of the piston and cylinder mechanisms 32*b* and 33*b* of FIGS. 8 and 9 may be similar to the mechanisms 32 and 33 of FIGS. 1 to 5, including an outer vertical cylinder body 38*b* and a piston 39*b* having an upwardly projecting tubular piston rod 42*b* which in the FIG. 8 lowermost position of the piston has its upper end surface 89 flush with the upper end surface 90 of cylinder 38*b*, with those surfaces 89 and 90 being disposed in the previously mentioned horizontal plane 87 of the upper rotary table supporting surfaces of "I" beams 84. The two cylinders may be located relative to one another and relative to "I" beams 84 by provision of a horizontally extending plate or template 91 which is clamped to the undersurfaces of the "I" beams in appropriate manner, as by J-shaped clamping fasteners 92 engaging the lower flanges of "I" beams 84 and projecting downwardly through openings in template 91, with nuts 93 being threadedly connected onto the lower ends of the fasteners 92 to tighten them downwardly into clamping engagement with the "I" beam flanges. Cylinders 38*b* extend through and are close fits within openings 94 in template 91 to locate the cylinders relative to the template.

For converting the arrangement of FIG. 8 to a jacking condition, there are provided two piston rod extensions 54*b*, having lower pin ends 55*b* projecting into the upper ends of the piston rods 42*b*, with downwardly facing shoulders 57*b* on parts 54*b* engaging the upper ends of the piston rods to support elements 54*b* on the rods. The upper reduced diameter ends 95 of extensions 54*b* project through openings 96 in upper beam 34*b*, and may be retained in assembled relation by snap rings 97, with beam 34*b* resting on and being supported by annular shoulders 98 on parts 54*b*. Two gripping units 36*b* and 37*b* correspond to the gripping units 36 and 37 of FIG. 4 and rest on the two beams 34*b* and 35*b* respectively. The beam 35*b* rests on and is supported by flanges 48*b* formed at the upper ends of cylinders 38*b*, with beam 35*b* having locating lugs 99 projecting downwardly therefrom at different locations about flanges 48*b* to locate the beam on the cylinders for reception of elements 54*b* within openings 100 formed in beam 35*b*.

In using the apparatus of FIG. 8 for drilling, the rotary table 21*b* is positioned on "I" beams 84 in conventional manner, with vertical load forces being transmitted downwardly from the rotary table to "I" beams 84 and from those "I" beams to the substructure of the rig. During such drilling, pistons 39*b* are in their lowermost positions represented in FIG. 8, so that the upper ends of the cylinders and pistons are aligned horizontally with or flush with the upper surfaces 86 of "I" beams 84 to avoid interference with the rotary table or its operation. After the well has been drilled, the drill string is withdrawn upwardly and the rotary table is removed from the "I" beams 84. Beam 35*b* is then placed in the position of FIG. 9 in which it engages and is supported by the upper ends of cylinders 38*b*, and may also engage and be supported by "I" beams 84. The two rod extensions 54*b* are then inserted downwardly into connected engagement with the upper ends of the piston rods 42*b*, and the upper beam 34*b* is connected to the upper ends of extensions 54*b* as seen in FIG. 9. Gripping units 36*b* and 37*b* are then placed on the two beams 34*b* and 35*b*, and the jacking operation may then be performed in the same manner as described in connection with the first two forms of the invention.

While certain specific embodiments of the present invention have been disclosed as typical, the invention is of course not limited to these particular forms, but rather is applicable broadly to all such variations as fall within the scope of the appended claims.

We claim:

1. The method of drilling and casing a well with a rig having a rig floor, which comprises:

positioning in the rig a plurality of vertically extending fluid pressure actuated units each including a piston section and a cylinder section with a first of said sections being actuable vertically relative to the second section by pressure fluid, and with said units projecting downwardly beneath the level of said rig floor;

drilling a well with a drill string extending downwardly through the rig floor and past said fluid pressure actuated units while said units remain in said positions of projection downwardly beneath the level of the rig floor to avoid interference with the drilling operation;

removing said drill string from the well after said drilling operation;

connecting to said first sections of said actuating units, after the drilling operation, an extension structure which is movable upwardly and downwardly with said first sections and projects upwardly above the level of the rig floor and carries a first casing supporting device above the level of the rig floor; and then lowering a string of casing into the well by vertical reciprocation of said first sections of the fluid pressure actuated units and the connected extension structure and said first casing supporting device relative to a second casing supporting device, with the casing string being supported by said first device during downward movement thereof and by said second device during upward movement of the first device.

2. The method as recited in claim 1, including supporting said second device by said second sections of the fluid pressure actuated units.

3. The method as recited in claim 1, in which said second casing supporting device is not present at a predetermined active casing supporting position in the rig during the drilling operation, and is moved to said active position for support of the casing string after said drilling operation.

4. The method as recited in claim 1, in which said drill string is rotated by a rotary table located at a predetermined active position thereof in the rig during drilling, and said rotary table is removed from said active position in the rig after said drilling operation and before said lowering of the casing.

5. The method as recited in claim 1, in which said drill string is turned by a rotary table during said drilling operation, said method including supporting said rotary table by said fluid pressure actuated units during the drilling operation.

6. The method as recited in claim 1, in which said drill string is turned by a rotary table during said drilling operation, said method including supporting said rotary table by said fluid pressure actuated units during the drilling operation, and removing said rotary table from said active position thereof after the drilling operation and before said lowering of the casing.

7. The method as recited in claim 1, in which said extension structure is connected to said first sections of said fluid pressure actuated units by telescopic projection of portions of said extension structure downwardly into recesses in upper ends of said first sections.

8. The method as recited in claim 1, in which said fluid pressure actuated units are located entirely beneath the level of said rig floor during the drilling operation.

9. The method of drilling and casing a well with a rig having a rig floor containing an opening, which comprises:

positioning beneath the level of the rig floor a plurality of vertically extending fluid pressure actuated units each including a cylinder and a piston which is actuable vertically relative to the cylinder by pressure fluid;

drilling a well with a drill string extending downwardly through said opening in the rig floor and past said fluid pressure actuated units while said units remain beneath the level of the rig floor to avoid interference with the drilling operation;

removing said drill string from the well after said drilling operation;

moving to active positions in the rig after the drilling operation an extension structure and two casing supporting devices none of which were at said active positions during drilling, and with said extension structure being connected to said pistons for movement upwardly and downwardly therewith and projecting upwardly from and beyond the pistons to a level substantially above that of the rig floor, and with a first of said casing supporting devices being supported by and movable with said extension structure in a position of essentialy vertical alignment with the second casing supporting device; and then lowering a casing string into the well by vertical reciprocation of said pistons and said extension structure and said first casing supporting device relative to said cylinders and said second casing holding device, with the casing string being supported by said first device during downward movement of the pistons and by said second device during upward movement of the pistons.

10. The method as recited in claim 9, including supporting said second casing supporting device by said cylinders.

11. The method as recited in claim 9, in which said pistons during the drilling operation are retracted downwardly relative to said cylinders to positions in which upper extremities of the pistons are approximately flush with upper extremities of the cylinders.

12. The method as recited in claim 9, in which said drill string is turned by a rotary table during said drilling operation, said method including removing said rotary table from an active position thereof after the drilling operation, and positioning said second casing supporting device at essentially said active position of the rotary table.

13. The method as recited in claim 1, in which said drill string is turned by a rotary table during said drilling operation, said method including removing said rotary table from an active position thereof after the drilling operation, and positioning said second casing supporting device at essentially said active position of the rotary table.

14. The method of drilling and casing a well with a rig having a rig floor containing an opening, which comprises:

positioning substantially entirely beneath the level of the rig floor a plurality of vertically extending fluid pressure actuated units each including a cylinder and a piston contained therein and actuable vertically relative to the cylinder by pressure fluid;

drilling a well with a drill string extending downwardly through said opening in the rig floor and past said fluid pressure actuated units while said units remain substantially entirely beneath the level of the rig floor to avoid interference with the drilling operation;

turning the drill string by a rotary table during said drilling operation;

supporting the rotary table during drilling by a beam extending between said cylinders of said fluid pressure actuated units and supported by said cylinders;

removing said drill string from the well and said rotary table from said beam after said drilling operation;

locating at active positions in the rig after the drilling operation an extension structure and two casing supporting devices which were not present at said active positions during drilling, with said extension structure including two piston rod extensions connected to upper ends of said pistons and projecting upwardly therebeyond to a level substantially above the level of said rig floor and with an upper beam of the extension structure extending between said piston rod extensions at a level spaced above said first mentioned beam, and with a first of said casing supporting devices being supported by said upper beam and a second of said casing supporting devices being supported on said first beam at essentially said active position of the rotary table; and then lowering a casing string into the well by vertical reciprocation of said pistons and said piston rod extensions and said upper beam and said first casing supporting device relative to said cylinders and said first mentioned beam and said second casing supporting device, with the casing string being supported by said first device during downward movement of the pistons and by said second device during upward movement of the pistons.

15. The method as recited in claim 14, in which said pistons have tubular upper portions with upper extremities which are essentially flush with upper ends of said cylinders and with an upper portion of said first beam during the drilling operation, said piston rod extensions being connected to said pistons by insertion of portions thereof downwardly into said upper tubular portions of the pistons in supported relation.

* * * * *